US010934660B2

(12) United States Patent
Lee et al.

(10) Patent No.: US 10,934,660 B2
(45) Date of Patent: Mar. 2, 2021

(54) GARMENT PROCESSING DEVICE

(71) Applicant: LG ELECTRONICS INC., Seoul (KR)

(72) Inventors: Youngjoo Lee, Seoul (KR); Hongjun Cho, Seoul (KR); Sanghun Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 79 days.

(21) Appl. No.: 16/336,025

(22) PCT Filed: Sep. 22, 2017

(86) PCT No.: PCT/KR2017/010452
§ 371 (c)(1),
(2) Date: Mar. 22, 2019

(87) PCT Pub. No.: WO2018/056741
PCT Pub. Date: Mar. 29, 2019

(65) Prior Publication Data

US 2019/0368114 A1 Dec. 5, 2019

(30) Foreign Application Priority Data

Sep. 23, 2016 (KR) ..... 10-2016-0122186

(51) Int. Cl.
*D06F 39/14* (2006.01)
*D06F 49/00* (2006.01)

(52) U.S. Cl.
CPC ..... *D06F 39/14* (2013.01); *D06F 49/003* (2013.01)

(58) Field of Classification Search
CPC ..... D06F 39/14
See application file for complete search history.

(56) References Cited

U.S. PATENT DOCUMENTS 3,018,508 A 1/1962 Keeling, Sr.
3,698,781 A 10/1972 Dunn
(Continued)

FOREIGN PATENT DOCUMENTS

CN 103225194 7/2013
CN 103314151 9/2013
(Continued)

OTHER PUBLICATIONS

Chinese Office Action (with English translation) dated Aug. 4, 2020 issued in CN Application No. 201780058900.3.
(Continued)

*Primary Examiner* — Jason Y Ko
(74) *Attorney, Agent, or Firm* — KED & Associates, LLP

(57) ABSTRACT

A garment processing device comprising: a cabinet; a door; a first hinge comprising a first shaft disposed on one of the cabinet or the door, and a first shaft containing portion disposed on the other of the cabinet or the door such that the first shaft is contained therein in an attachable/detachable manner; a second hinge comprising a second shaft coupled to the door so as to form a first axis of rotation together with the first shaft and a third shaft for rotatably fixing the second shaft to the cabinet; a third hinge comprising a fourth shaft disposed on one of the cabinet or the door so as to form a second axis of rotation together with the third shaft, and a fourth shaft containing portion disposed on the other of the cabinet or the door such that the fourth shaft is contained therein in an attachable/detachable manner.

20 Claims, 11 Drawing Sheets

(56) References Cited

U.S. PATENT DOCUMENTS

| | | | | |
|---|---|---|---|---|
| 8,936,330 | B2 | 1/2015 | Kim et al. | |
| 2012/0161594 | A1* | 6/2012 | Kim | D06F 39/14 312/228 |
| 2012/0187811 | A1 | 7/2012 | Kim et al. | |
| 2012/0217851 | A1 | 8/2012 | Bae et al. | |
| 2013/0076220 | A1 | 3/2013 | Yeom et al. | |
| 2013/0193823 | A1 | 8/2013 | Cho et al. | |
| 2014/0035453 | A1 | 2/2014 | Kwon et al. | |
| 2015/0233042 | A1* | 8/2015 | Kang | D06F 39/12 312/228 |
| 2015/0233043 | A1 | 8/2015 | Sim et al. | |
| 2016/0076187 | A1 | 3/2016 | Lee et al. | |
| 2016/0194802 | A1 | 7/2016 | Heo et al. | |
| 2017/0009392 | A1 | 1/2017 | Lee et al. | |

FOREIGN PATENT DOCUMENTS

| | | |
|---|---|---|
| CN | 103608510 | 2/2014 |
| CN | 104846585 | 8/2015 |
| CN | 104846600 | 8/2015 |
| CN | 105420986 | 3/2016 |
| KR | 20-1995-00009 50 | 2/1995 |
| KR | 20-1995-00059 49 | 7/1995 |
| KR | 20-0138847 | 4/1999 |
| KR | 20-1999-0029441 | 7/1999 |
| KR | 10-0640751 | 10/2006 |
| KR | 10-2013-0032993 | 4/2013 |
| KR | 10-2013-0071844 | 7/2013 |
| KR | 10-2014-0018565 | 2/2014 |
| KR | 10-2015-0097185 | 8/2015 |
| KR | 10-2015-0109814 | 10/2015 |
| KR | 10-2016-0084327 | 7/2016 |
| KR | 10-1653314 | 9/2016 |

OTHER PUBLICATIONS

Chinese Office Action (with English translation) dated Aug. 5, 2020 issued in CN Application No. 201780058899.4.

United States Notice of Allowance dated Apr. 15, 2020 issued in U.S. Appl. No. 16/336,048.

United States Notice of Allowance dated Apr. 15, 2020 issued in U.S. Appl. No. 16/336,057.

International Search Report and Written Opinion (with English Translation) dated Jan. 4, 2018 issued in Application No. PCT/KR2017/010450.

International Search Report and Written Opinion (with English Translation) dated Jan. 11, 2018 issued in Application No. PCT/KR2017/010479.

International Search Report and Written Opinion (with English Translation) dated Jan. 11, 2018 issued in Application No. PCT/KR2017/010452.

International Search Report and Written Opinion (with English Translation) dated Jan. 19, 2018 issued in Application No. PCT/KR2017/010474.

* cited by examiner (a)

(b)

GARMENT PROCESSING DEVICE

CROSS-REFERENCE TO RELATED PATENT APPLICATIONS

This application is a U.S. National Stage Application under 35 U.S.C. § 371 of PCT Application No. PCT/KR2017/010452, filed Sep. 22, 2017, which claims priority to Korean Patent Application No. 10-2016-0122186, filed Sep. 23, 2016, whose entire disclosures are hereby incorporated by reference.

TECHNICAL FIELD

The present disclosure relates to a laundry-treating apparatus.

BACKGROUND

In general, the laundry-treating apparatus refers to a collective term of home appliances capable of washing or drying laundry, or washing and drying the laundry.

In the laundry-treating apparatus, laundry washing removes contaminants from the laundry via interaction between water and detergent. Drying of laundry removes moisture contained in laundry via a hot air supply device provided in the laundry-treating apparatus.

Conventionally, a laundry-treating apparatus includes a cabinet forming an appearance, a laundry receiving portion provided in the cabinet for receiving laundry, a laundry inlet defined in the cabinet for communicating with the laundry receiving portion, and a door for opening and closing the laundry inlet.

In the conventional laundry-treating apparatus, the door is generally pivotable about a vertical axis formed along a height direction of the cabinet.

DISCLOSURE

Technical Purpose

One purpose of the present disclosure is to provide a laundry-treating apparatus in which a pivoting direction of a door is switched to open a laundry inlet.

Further, another purpose of the present disclosure is to provide a laundry-treating apparatus in which a position of one of two pivoting axes mounted on a door easily switches from a left side of the door to a right side of the door or from the right side to the left side of the door.

Technical Solution

In one aspect of the present disclosure, there is provided a laundry-treating apparatus comprising: a cabinet having a laundry inlet defined therein; a laundry receiving portion defined in the cabinet, wherein the laundry receiving portion communicates with the laundry inlet; a door for opening and closing the laundry inlet; a first hinge including: a first shaft disposed on one of the cabinet or the door and defining a first pivoting axis for the door; and a first shaft receiving portion disposed on the other of the cabinet and the door, wherein the first shaft receiving portion removably receives the first shaft therein; a second hinge including: a second shaft coupled to the door wherein a combination of the first and second shafts defines the first pivoting axis; and a third shaft for pivotably fixing the second shaft to the cabinet, wherein the third shaft defines a second pivoting axis for the door; a third hinge including: a fourth shaft disposed on one of the cabinet or the door, wherein a combination of the third and fourth shafts defines the second pivoting axis; and a fourth shaft receiving portion disposed on the other of the cabinet and the door, wherein the fourth shaft receiving portion removably receives the fourth shaft therein; a handle disposed on the door; first and second driving portions sandwiching the handle therebetween, wherein when an external force is applied to the handle, each of the first and second driving portions is constructed to move toward or away from the handle; a first shaft controller operatively coupled to the first driving portion to open or close the first shaft receiving portion during actuation of the first driving portion; and a driven portion, wherein when, upon application of an external force to the handle, the first driving portion moves the first shaft controller to open the first shaft receiving portion, the second driving portion is constructed to enable the driven portion to move toward the third hinge to close the fourth shaft receiving portion.

In one implementation, the apparatus further comprises: a first attached and detached portion defined in the first driving portion, wherein the first shaft controller is removably inserted into the first attached and detached portion; a second attached and detached portion defined in the second driving portion, wherein the first shaft controller is removably inserted into the second attached and detached portion; a first fastener disposed on the door for securing the first shaft receiving portion to face a free end of the first driving portion; a second fastener disposed on the door for securing the first shaft receiving portion to face a free end of the second driving portion, wherein the second fastener is positioned to be axially symmetric with the first fastener around a vertical line passing through a center of the door; a cover disposed on the door to pivotably secure the second shaft to the door; a cover fastener disposed on the door to secure the cover to the door; and a body fastener disposed on the door to secure the fourth shaft to the door, wherein the body fastener is positioned to be axially symmetric with the cover fastener around a vertical line passing through a center of the door.

In one implementation, the first hinge further includes: a housing secured to the door, the housing defining the first shaft receiving portion; a guide disposed on the housing to guide a movement of the first shaft controller; and an elastic member having one end fixed to the housing and the other end fixed to the first shaft controller, wherein the elastic member presses the first shaft controller to close the first shaft receiving portion.

In one implementation, the apparatus further comprises: a first attached and detached portion defined in the first driving portion, wherein the first shaft controller is removably inserted into the first attached and detached portion; a second attached and detached portion defined in the second driving portion, wherein the first shaft controller is removably inserted into the second attached and detached portion; a first fastener disposed on the door for securing the housing to face a free end of the first driving portion; a second fastener disposed on the door for securing the housing to face a free end of the second driving portion, wherein the second fastener is positioned to be axially symmetric with the first fastener around a vertical line passing through a center of the door; a cover disposed on the door to pivotably secure the second shaft to the door; a cover fastener disposed on the door to secure the cover to the door; and a body fastener disposed on the door to secure the fourth shaft to the door, wherein the body fastener is positioned to be axially symmetric with the cover fastener around a vertical line passing through a center of the door.

In one implementation, the driven portion includes: a driven body disposed between the second driving portion and the third hinge, wherein when an external force is applied to the handle to actuate the second driving portion, the driven body is constructed to closes the fourth shaft receiving portion; and restoring means for supplying an elastic force to move the driven body to open the fourth shaft receiving portion.

In one implementation, the restoring means includes: a casing detachably secured to the door, wherein the driven body passes through the casing; and an elastic member having one end fixed to the casing and the other end fixed to the driven body, wherein the elastic member supplies an elastic force to move the driven body to open the fourth shaft receiving portion.

In one implementation, the apparatus further comprises: first and second through-holes respectively in top and bottom faces of the casing, wherein the driven body passes through the first and second through-holes; a third through-holes defined in the bottom face of the casing; a stopper extending from the driven body, wherein the stopper is positioned between the first through-hole and the third through-hole; and a guide extending from the stopper and inserted into the third through-hole, wherein the guide guides a movement of the driven body.

In one implementation, the handle includes: a handle body pivotally secured to the door; and first and second inputs disposed on the handle body and spaced apart from each other, wherein the first driving portion includes a first contact, wherein when the handle body pivots, the first input presses the first contact to move the first driving portion toward the handle body, wherein the second driving portion includes a second contact, wherein when the handle body pivots, the second input presses the second contact to move the second driving portion toward the handle body.

In one implementation, the apparatus further comprises: a first rack fixed to the first contact and protruding from the first contact toward the second contact; a second rack secured to the second contact and protruding from the second contact toward the first contact; and a connection gear to connect the first rack and the second rack, wherein the connection gear is constructed to transmit an external force between the first rack and the second rack.

In one implementation, the first driving portion further includes: a first driving body disposed between the handle and the first hinge, wherein the first driving body has the first attached and detached portion and the first contact; and a first movable portion disposed on the first driving body, wherein the second driving portion further includes: a second driving body positioned to be axially symmetrical with the first driving body around a vertical line passing through a center of the door, wherein the second driving body has the second attached and detached portion and the second contact; and a second movable portion disposed on the second driving body and contacting the driven portion, wherein the first movable portion and the second movable portion are axially-symmetric with each other about the vertical line passing through the center of the door.

In one implementation, the apparatus further comprises a first lock, wherein when the door opens the laundry inlet, the first lock is constructed to lock the first and second driving portions.

In one implementation, the apparatus further comprises a second lock, wherein when the door opens the laundry inlet, the second lock is constructed to lock the driven portion.

Technical Effect

In accordance with the present disclosure, a laundry-treating apparatus in which a pivoting direction of a door is switched to open a laundry inlet may be realized.

Further, in accordance with the present disclosure, a laundry-treating apparatus in which a position of one of two pivoting axes mounted on a door easily switches from a left side of the door to a right side of the door or from the right side to the left side of the door may be realized.

DETAILED DESCRIPTIONS

Figure 1:
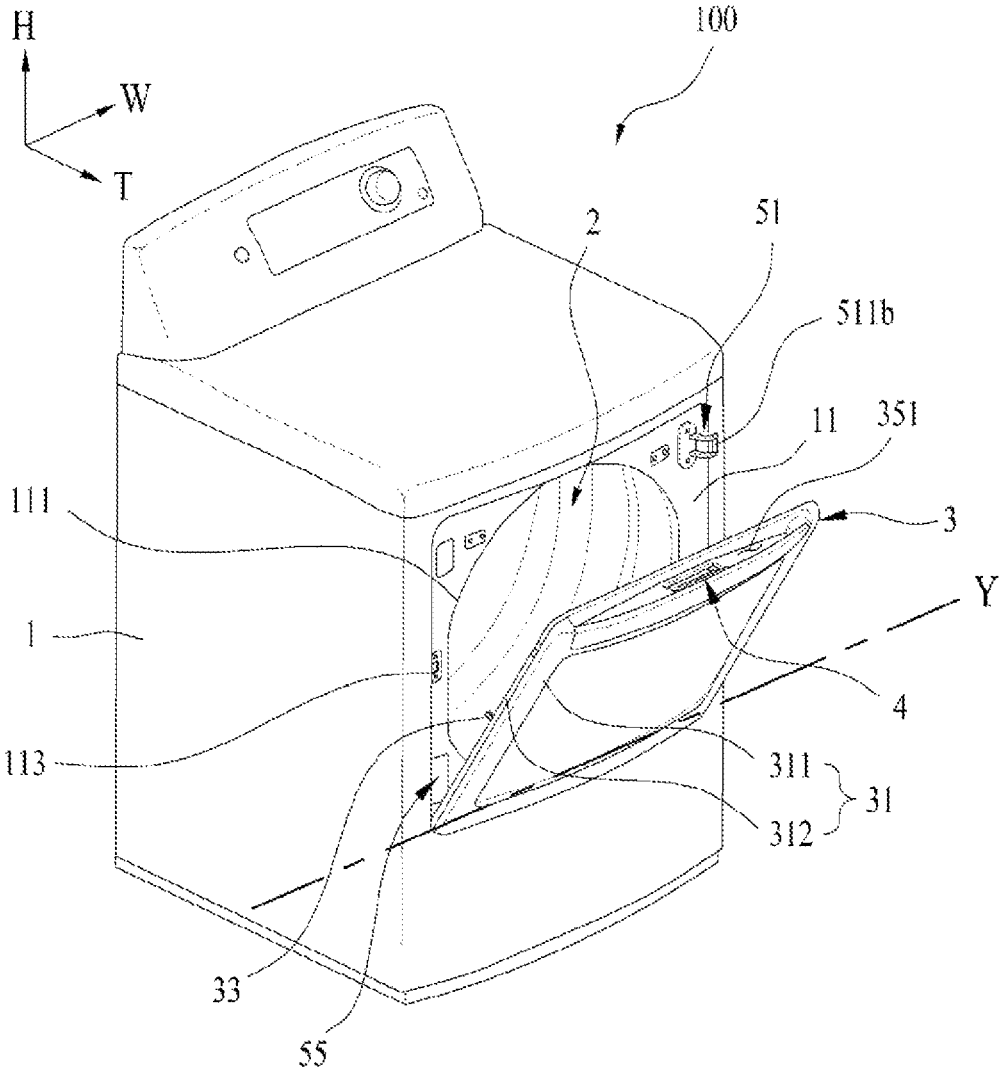
FIG. 1 shows an example of laundry-treating apparatus in accordance with the present disclosure, in which a door pivots around a second pivoting axis to open an laundry inlet.

Hereinafter, preferred embodiments of the present disclosure will be described in detail with reference to the accompanying drawings. A configuration and control method of the apparatus as described below are intended to illustrate embodiments of the present disclosure and not to limit the scope of the present disclosure. Like reference numerals refer to like elements throughout the present specification.

As shown in FIG. 1, a laundry-treating apparatus 100 according to the present disclosure includes a cabinet 1 forming an appearance, a laundry receiving portion 2 defined in the cabinet 1 for accommodating laundry, and a door 3 disposed on the cabinet 1 for exposing the laundry receiving portion 2 to the outside.

A front panel 11 of the cabinet 1 has a laundry inlet (or inlet) 111 defined therein. The door 3 is disposed on the front panel 11 so that the laundry inlet 111 may be opened and closed by the door 3. Thus, the user may pivot the door 3 to open the laundry inlet 111 to load laundry (washing or drying target) into the laundry receiving portion 2 or draw the laundry from the receiving space 2.

When the laundry-treating apparatus 100 according to the present disclosure functions as a washing apparatus, a tub for storing wash-water therein is disposed in the cabinet, and a drum is rotatably installed in the tub and has a space for accommodating laundry defined therein. In this case, the tub has a tub laundry inlet communicating with the laundry inlet 111. The drum has a drum laundry inlet communicating with the tub laundry inlet and the laundry inlet 111.

Further, the laundry-treating apparatus 100 further includes a washing-water supply (not shown) for supplying washing water to the tub, and a washing-water discharger (not shown) for discharging washing water stored in the tub to the outside of the cabinet 1.

In an alternative, when the laundry-treating apparatus 100 according to the present disclosure only acts to dry laundry, the laundry receiving portion 2 is defined only in the drum rotatably installed in the cabinet 1. That is, the tub is absent. In this case, an air supply (not shown) is present inside the cabinet to supply hot air to the drum. Further, an air discharger (not shown) is present inside the cabinet to discharge the air from the drum to the outside of the drum.

In one example, the laundry-treating apparatus 100 according to the present disclosure may be capable of washing and drying laundry. In this case, the tub for storing wash-water therein is disposed in the cabinet, and the drum is rotatably installed in the tub and has a space for accommodating laundry defined therein. The cabinet will include a washing-water supply, a washing-water discharger, and an air supply (not shown) for supplying hot air to the tub.

The door 3 disposed on the front panel 11 for opening and closing the laundry inlet 111 is pivotable around two different pivoting axes (X, Y). The door 3 is coupled to a front panel 11 via hinges 51, 53 and 55. The user may switch the pivoting axis (X, Y) for the door 3 via the handle 4.

The door 3 may include a door body 31 for opening and closing the laundry inlet 111, and a door lock 33 for detachably fixing the door body 31 to the front panel 11.

The door body 31 may include an outer frame 311 forming an outer circumferential surface of the laundry-treating apparatus 100, and an inner frame 312 coupled to the outer frame 311 and facing the laundry inlet.

The door lock 33 may protrude from a surface of the inner frame 312. In this case, the front panel 11 may further include a door lock catch 113 into which the door lock 33 is to be accommodated. In one example, the door lock 33 and the door lock catch 113 may be embodied in any configuration as long as the door body 31 may be detachably secured to the front panel 11 via the door lock 33 and the door lock catch 113.

Figure 2:
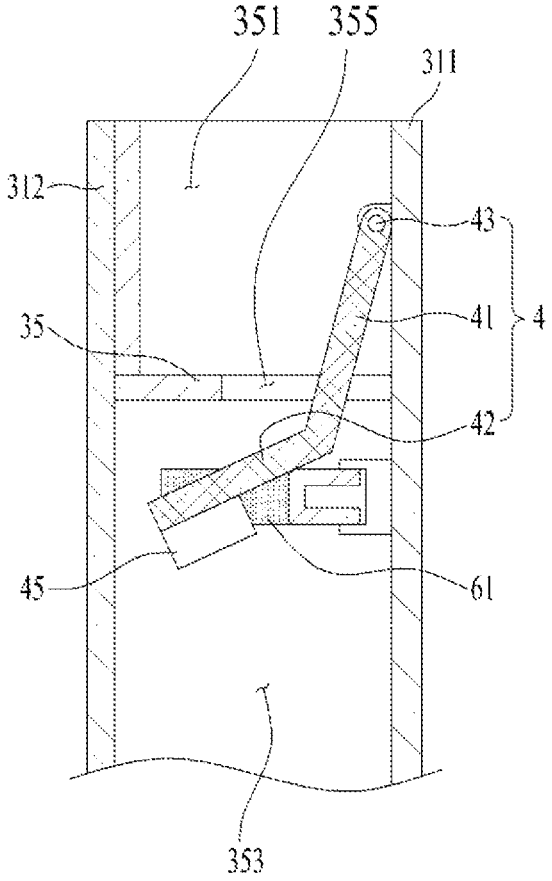
FIG. 2 shows an example of a handle disposed on the laundry-treating apparatus in accordance with the present disclosure.

As shown in FIG. 2, the door 3 includes a first receiving space 351 exposed outside the door, and a second receiving space 353 separated from the first receiving space 351 via a partitioning wall 315 and defined inside the door.

The handle 4 may include a handle body 41 and 42 pivotably secured to the door via a hinge shaft 43. The handle body is inserted into a through-hole 355 defined in the partitioning wall 35. One end of the handle body is located in the first receiving space 351, while the other end thereof is located in the second receiving space 353.

That is, the handle body may include a first handle body 41 located at the first receiving space 351 and a second handle body 42 positioned at the second receiving space 353. The first handle body 41 is pivotably secured to the outer frame 311 via the hinge shaft 43. The second handle body 42 may extend from a free end of the first handle body 41 in a bent manner toward the partitioning wall 35.

The second handle body 42 includes a first input (or first extension) 45 and a second input (or second extension) 46 (see FIG. 5) that actuate a first switch 61 and 63 as described below according to a pivot angle of the first handle body 41. The first switch 61 and 63 actuates the second switch 65 to switch the pivoting axis (X, Y). A detailed description thereof will be described later.

Figure 3:
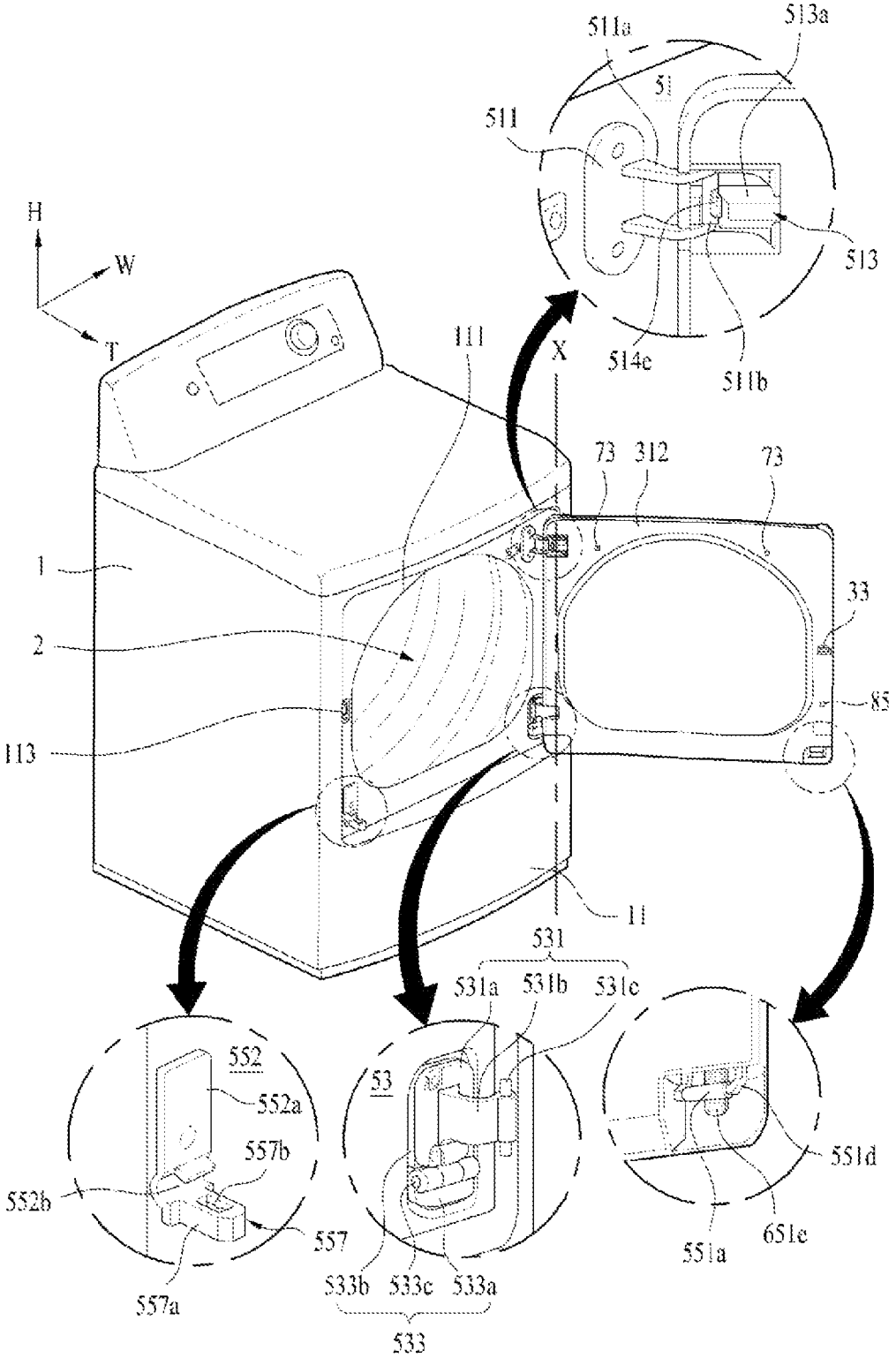
FIG. 3 shows a case when the door pivots about a first pivoting axis to open the laundry inlet.

As shown in FIG. 3, the hinge assemblies 51, 53 and 55 for coupling the door body 31 to the front panel 11 include a first hinge 51 having a first shaft 511*b*, a third hinge 551 and 552 having a fourth shaft 551*a*, and a second hinge 53 having a second shaft 531*c* defining a first pivoting axis X together with the first shaft 511*b*, and a third shaft 533*c* defining a second pivoting axis Y (see FIG. 1) together with the fourth shaft 551*a*.

The first hinge 51 may include a first hinge body 511 disposed on one of the front panel 11 and the door body 31. The first shaft 511*b* is fixed to the first hinge body 511. The first hinge 51 may further include a first shaft receiving structure 513 which is disposed on the other of the front panel 11 and the door body 3. The first shaft 511 is detachably received in first shaft receiving structure 513.

FIG. 3 shows one example in which the first hinge body 511 is fixed to the front panel 11, and the first shaft receiving structure 513 is disposed on the door body 31. In this case, the first hinge body 511 includes a shaft support 511*a* supporting the first shaft 511*b*. The shaft support 511*a* may protrude from the front panel 11 and be bent in a direction parallel to the front panel and away from the laundry inlet 111.

Figure 4:
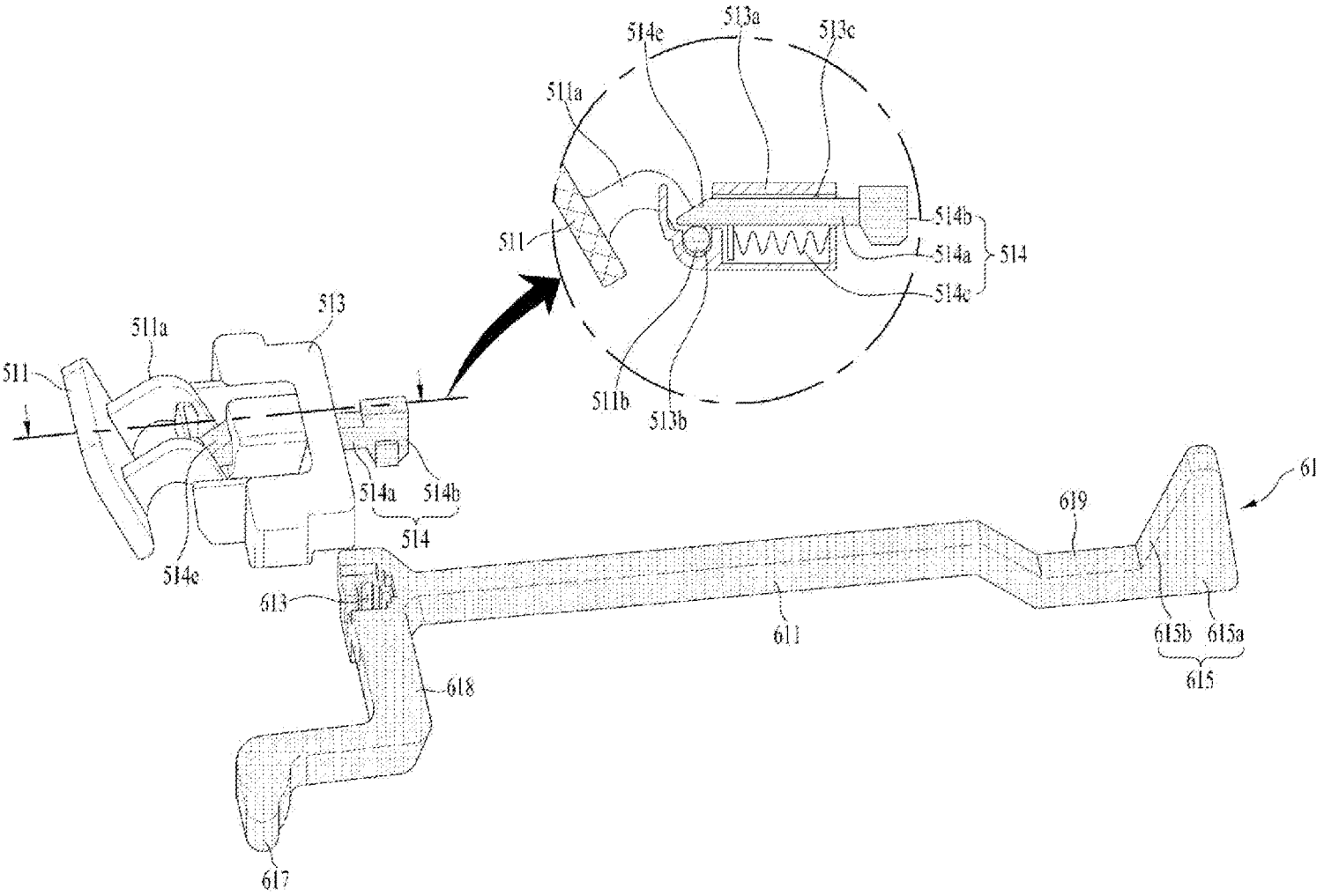
FIG. 4 shows an example of a first shaft controller disposed on the laundry-treating apparatus in accordance with the present disclosure.

As shown in FIG. 4, the first shaft receiving structure 513 includes a housing 513*a* fixed to the door body 31, and a first shaft receiving space 513*b* (or first receiving space) defined in the housing 513*a* to provide a space for accommodating the first shaft 511*b*. In this case, the first shaft receiving space 513*b* should be disposed on the inner frame 312 so as to be exposed to the outside.

In one example, the first shaft receiving structure 513 may include a first shaft controller 514 that opens and closes the first shaft receiving space 513*b*. The first shaft controller 514 may include a first bar 514*a* inserted into a controller guide 513*c* passing through the housing 513*a*. The controller guide 513*c* acts for providing a path along which the first shaft controller 514 moves.

One end of the first bar 514*a* includes a head 514*b* that is detachably secured to the first switch 61 and 63 to be described later. Thus, the free end 514*e* of the first bar 514*a* may open or close the first shaft receiving space 513*b* depending on whether the head 514*b* moves.

When the free end 514*e* of the first bar 514*a* closes the first shaft receiving space 513*b*, the first shaft 511*b* is prevented from being drawn out of the first shaft receiving space 513*b* or inserted into the first shaft receiving space 513*b*. However, when the free end 514*e* opens the first shaft receiving space 513*b*, the first shaft 511*b* may be withdrawn from the first shaft receiving space 513*b* or be insertable into the first shaft receiving space 513*b*.

In one example, the first bar 514*a* may be configured to receive a restoring force from an elastic member 514*c*, thereby allowing the bar 514*a* to return to an initial position. The elastic member 514*c* may include a spring. One end of the spring is fixed to the housing 513*a* and the other end thereof is fixed to the first bar 514*a*. In this case, the elastic member 514*c* is preferably configured to supply an elastic force to the first bar 514*a* so that the free end 514*e* of the first bar keeps closing the first shaft receiving space 513*b*.

The first hinge 51 may be fixed to either a left side of the door or a right side of the door via a first fastener 311*a* or a second fastener 311*b* disposed on the outer frame 311 respectively. The first fastener 311*a* and the second fastener 311*b* may be arranged to have an axial symmetry to each other around a vertical line H1 passing through a center of the door (see FIG. 5 and FIG. 8).

As shown in FIG. 3, the second hinge 53 may include a door support 531 having a second shaft 531*c*, and a cabinet hinge portion 533 for pivotably fixing the door support 531 to the front panel 11 via a third shaft 533*c*.

The cabinet hinge portion 533 may include a hinge body 533*a* secured to the front panel 11 and a pivotable plate 533*b* pivotably coupled to the hinge body 533*a* via the third shaft 533*c*.

In this case, the door support 531 may include a support body 531*a* fixed to the pivotable plate 533*b*, and a second shaft support 531*b* protruding from the support body 531*a* to support the second shaft 531*c*.

Figure 5:
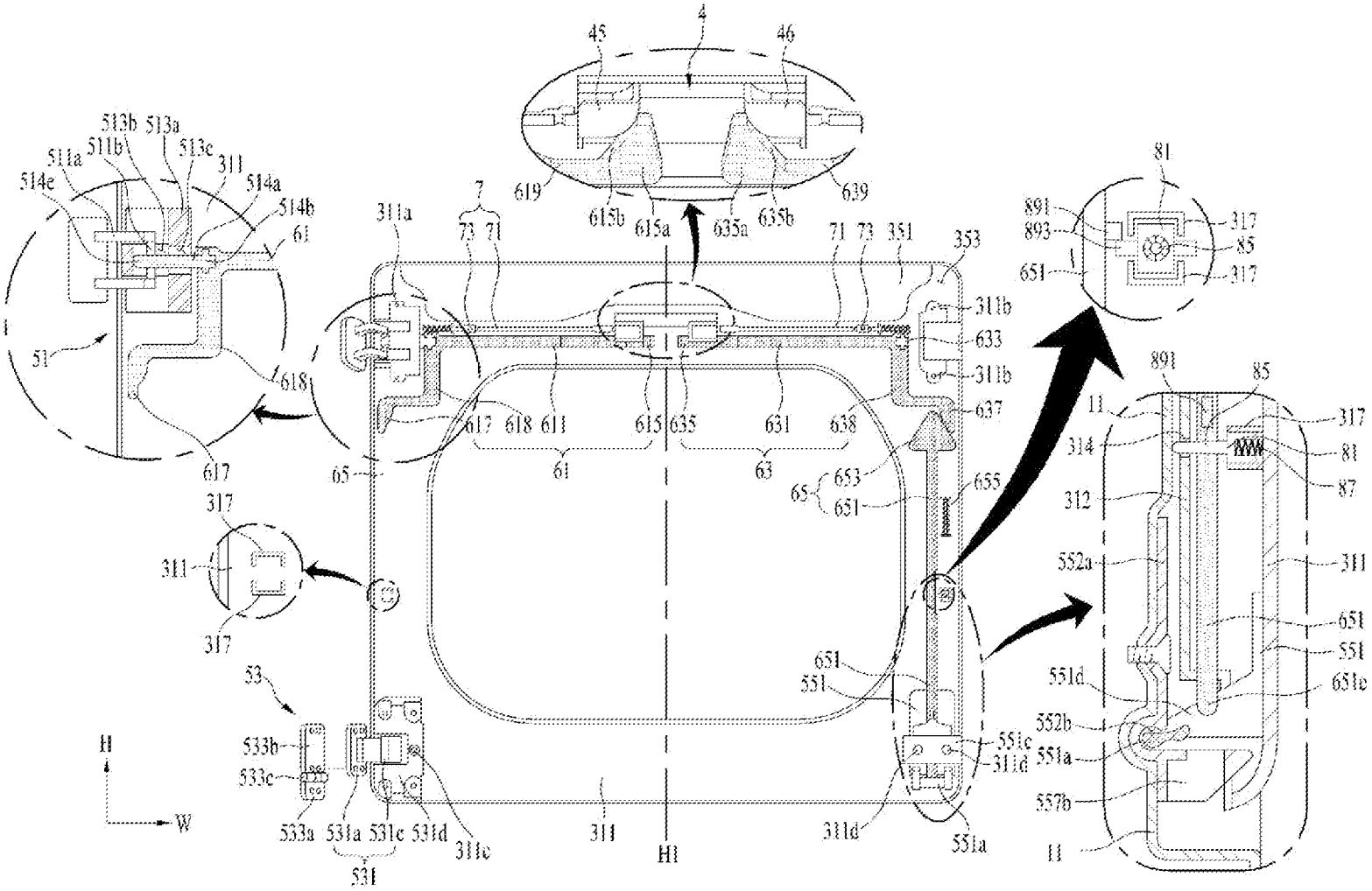
FIG. 5 to FIG. 7 show an operation of a first switch and a second switch.

The second shaft 531*c* is pivotably coupled to the door body 31 via a second shaft cover 531*d* (see FIG. 5). The second shaft 531*c* is aligned with the first shaft 511*b* of the first hinge 51 in a linear manner. Thus, the first pivoting axis X is defined by the first shaft 511*b* and second shaft 531*c*.

The third hinge may include a fourth shaft 551*a* disposed on one of the door body 31 and the front panel 11, a fourth shaft receiving structure 552 disposed on the other of the door body 31 and the front panel 11. The fourth shaft 551*a* is detachably received in the fourth shaft receiving structure 552. FIG. 3 shows an example in which the fourth shaft 551*a* is disposed on the door body 31 and the fourth shaft receiving structure 552 is disposed on the front panel 11.

The fourth shaft receiving structure 552 may include a body 552*a* secured to the front panel 11, a fourth shaft receiving space (or second receiving space) 552*b* defined in the body 552*a* and providing a space for receiving the fourth shaft 551*a*, and a switch receiving portion 557 extending from the body 552*a*. A free end 651*e* of the second switch 65 to be described later is inserted into the switch receiving portion 557.

The fourth shaft receiving space 552*b* may be embodied as a groove formed by concavely bending the body 552*a*. The fourth shaft receiving space 552*b* is aligned in parallel with (in the same straight line) the third shaft 533*c* of the second hinge 53. The fourth shaft 551*a* inserted in the fourth shaft receiving space 552*b* defines the second pivoting axis Y (see FIG. 1) together with the third shaft 533*c*.

The switch receiving portion 557 may include a receiving body 557*a* protruding from the body 552*a* and located below the fourth shaft receiving space 552*b*, and a through-hole 557*b* penetrating the receiving body 557*a*.

In one example, as shown in FIG. 5, the fourth shaft 551*a* may be disposed on a third hinge body 551 fixed to the door body 31. The third hinge body 551 includes a fourth shaft support 551*d* that spaces the fourth shaft 551*a* from the third hinge body 551 by a predetermined distance. The fourth shaft 551*a* fixed to the fourth shaft support 551*d* is exposed to the outside of the inner frame 312.

The third hinge body 551 may further include a guide 551*c* for providing a travel path of the second switch 65, which will be described later. The guide 551*c* may include at least one of a groove extending in a vertical direction of the third hinge body 551 and receiving the second switch 65, and a cover (not shown) that prevents the second switch 65 inserted in the groove from being pulled out of the groove.

The second hinge 53 may be fixed to the door 3 via a shaft cover fastener 311*c* disposed on the outer frame 311. The third hinge 55 may be fixed to the door 3 via a body fastener 311*d* disposed on the outer frame 311.

In this case, the second hinge 53 may be fixed to the door via the shaft cover fastener 311*c* (for example, bolt) passing through the second shaft cover 531*d*. The third hinge 55 will be secured to the door via the body fastener 311*d* (for example, bolt) passing through the third hinge body 551 or guide 551*c*.

In order that a position of the second hinge 53 and a position of the third hinge 55 may be exchanged with each other, the shaft cover fastener 311*c* and the body fastener 311*d* may be disposed axially symmetrically with each other around the vertical line H1 passing through the center of the door.

The interior of the door 3 includes pivoting axis switches 61 and 63, 65, which enables the pivoting axis (X, Y) of the door to switch depending on whether an external force is applied to the handle 4.

The pivoting axis switches may include a first switch 61 and 63 for controlling a position of the first shaft controller 514 to open and close the first shaft receiving space 513*b*, and a second switch (or third driven linkage) 65 actuated by the first switch to close the fourth shaft receiving space 552*b* when the first shaft receiving space 513*b* is opened.

The first switch may include a first driving portion (or first driving linkage) 61 and a second driving portion (or second driving linkage) 63 that translate in a width direction W of the door and which are spaced apart from each other with the handle 4 interposed therebetween.

The first driving portion 61 and the second driving portion 63 may be configured so that when the external force is applied to the handle 4, the first driving portion 61 and the second driving portion 63 move toward the handle 4 when an external force is input to the handle. In an alternative, the first driving portion 61 and the second driving portion 63 may be configured so that when the external force is applied to the handle 4, the first driving portion 61 and the second driving portion 63 move away the handle 4 when an external force is input to the handle. FIG. 5 shows an example of the former configuration.

The first driving portion 61 may include a bar-shaped first driving body (or first arm body) 611 located between the handle 4 and the first shaft controller (or first shaft latch) 514. One end of the first driving body 611 includes a first movable portion (or first driving linkage extension) 617 and a first attached and detached portion (or first slot) 613 (see FIG. 4) in which the first shaft controller 514 is detachably received. The other end of the first driving body 611 includes a first contact (or first contact surface) 615 which is urged by a first input 45 disposed on the handle.

The first attached and detached portion 613 may be embodied in any shape as long as the attached and detached portion 613 can detachably or fixedly receive the head 514*b* of the first shaft controller.

The first movable portion 617 protrudes from the first driving body 611 toward the second hinge 53. The first movable portion 617 may be embodied in any shape as long as the first movable portion 617 contacts the second switch 65 when the position of the second switch 63 changes from a right side to a left side of the door to change the position of the first pivoting axis X.

FIG. 5 shows an example in which the first movable portion 617 is fixed to the first driving body 611 via the first connection bar 618. This configuration is to prevent the first movable portion 617 from interfering with the first shaft receiving structure 513 during actuation of the first driving body 611.

The first contact 615 may act for transferring an external force input to the handle to the first driving body 611 when the contact 615 contacts the first input 45 when an external force is input to the handle 4. To this end, the first contact 615 includes a contact body 615*a* projecting from the first driving body 611 toward the first input 45, and an inclined face 615*b* formed on the contact body and contacting the first input 45. The inclined face 615*b* may incline upwards as it goes away from the first attached and detached portion 613.

Since the first contact 615 must be disposed inside the door body 31 with a limited thickness, the first driving body 611 may further includes a first bent portion 619 bent toward the outer frame 311, and the first contact 615 may be coupled to the first bent portion 619.

The second driving portion 63 may include the same structure as the first driving portion 61. That is, the second driving portion 63 may include a second driving body (or second driving linkage body) 631 in a form of a bar that translates in the same straight line in which the first driving body 611 translates. The second driving body 631 may be embodied as a bar that reciprocates between the handle 4 and the second fastener 311*b*.

One end of the second driving body 631 includes a second movable portion (or second driving linkage extension) 637 and a second attached and detached portion (or second slot) 633 to which the first shaft controller 514 is detachably secured. The other end of the second driving body 631 includes a second contact (or second contact surface) 635 which is pressurized by a second input 46 disposed on the handle.

The second driving body 631 includes the second attached and detached portion 633 that may be detachably coupled to the first shaft controller 514. Thus, the first shaft controller 514 may be secured to the first driving portion 61 or the second driving portion 63.

The second moving portion 637 projects from the second driving body 631 toward the second switch 65, that is, toward the fourth shaft 551*a*. FIG. 5 shows an example in which the second movable portion 637 is fixed to the second driving body 631 via a second connection bar 638. This configuration is to prevent the second movable portion 637 from interfering with the second fastener 311*b* during actuation of the second driving body 631.

In one example, the second movable portion 637 is positioned in a axial symmetrical manner with the first movable portion 617 about a vertical line H1 passing through the center of the door. Thus, this configuration may allow the second switch 65 to be actuated by the first movable portion 617 when the position of the second switch 65 to be described later is changed from the right side to the left side of the door 3 in order to change the position of the first pivoting axis X.

The second contact 635 acts for transferring the external force input to the handle to the second driving body 631 when the contact 635 contacts the second input 46 when an external force is applied to the handle 4.

To this end, the second contact 635 includes a contact body 635*a* projecting from the second driving body 631 toward the second input 46, and an inclined face 635*b* defined on the contact body and contacting the second input 46. The inclined face 635*b* may slope upwards when it goes away from the second attached and detached portion 633.

Since the second contact 635 must be disposed inside the door body 31 with a limited thickness, the second driving body 631 further include a second bent portion 639 bent toward the outer frame 311, and the second contact 635 may be coupled to the second bent portion 639.

In one example, the second switch 65 may include a bar-shaped driven body 651 that translates between the second fastener 311*b* and the fourth shaft 551*a*, and a contact 653 (or third contact surface) disposed on the driven body 651 and contacting the second movable portion 637.

A free end 651*e* of the driven body 651 is inserted into a space defined in the fourth shaft support 551*d* and between the fourth shaft 551*a* and the third hinge body 551. The free end 651*e* is inserted into the through-hole 557*b* and opens or closes the fourth shaft receiving space 552*b* according to the position of the second driving body 631.

Figure 6:
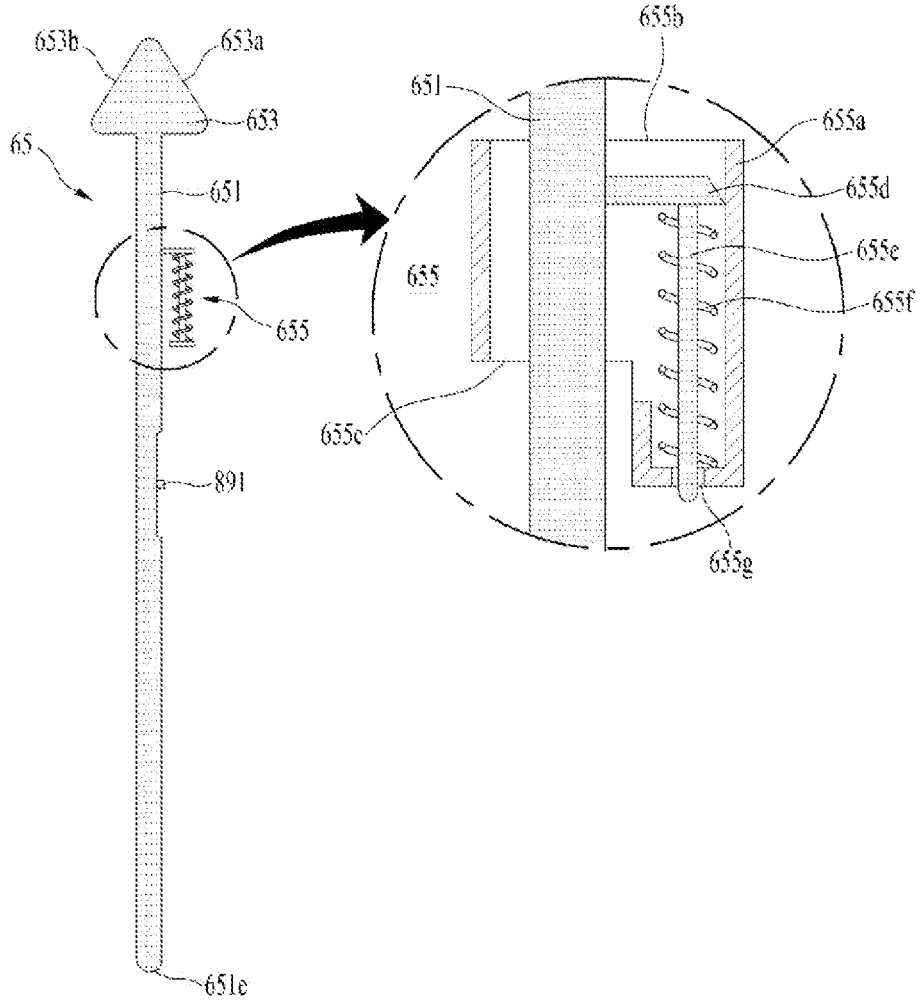

As shown in FIG. 6, the contact 653 acts for transmitting the external force to the driven body 651 when the force is input via the second input 46 disposed on the handle to the second driving body 631. The contact 653 may include an inclined face in contact with the second movable portion 637.

The contact 653 may include a first inclined contact face 653*a*. The first inclined contact face 653*a* may allow the driven body 651 to move toward the switch receiving portion 557 when the second driving body 631 moves toward the handle 4. That is, the first inclined contact face 653*a* may have downward slope as it goes away from the free end 651*e* of the driven body.

However, when the shape of the second switch 65 is configured to be symmetrical around the vertical line passing through the center of the driven body 651, the contact 653 may further have a second inclined contact face 653*b*. When the user moves the second switch 65 to the left side of the door 3 to change a position of the first pivoting axis X, the first movable portion 617 may be in contact with the second inclined contact face 653*b*.

In one example, the contact 653 may remain in contact with the second movable portion 637 via restoring means 655. The restoring means 655 may include a spring that urges the driven body 651 toward the second driving body 631 (in a direction in which the free end of the driven body opens the fourth shaft receiving space).

Further, the restoring means 655 includes a casing 655*a* detachably fixed to the door 3, a first through-hole 655*b* and a second through-hole 655*c* respectively defined in top and bottom faces of the casing, wherein the driven body 651 passes through the first through-hole 655*b* and a second through-hole 655*c*, and an elastic member 655*f* having one end fixed to the casing 655*a* and the other end fixed to the driven body 651 to supply elasticity to move the driven body 651 toward the second driving body 631.

When the restoring means 655 is configured in the above-described manner, a following advantage may occur. When the user changes the positions of the housing 513*a*, the second hinge 53 and the third hinge body 551 to change the position of the first pivoting axis X, the elastic member 655*f* may be moved together with the second switch 65, such that the process of repositioning of the first pivoting axis X may be facilitated.

In order to facilitate the reciprocating movement of the driven body 651 along the vertical direction H of the door, the restoring means 655 may further include a third through-hole 655*g* defined in a bottom face of the casing, a stopper 655*d* extending from the driven body 651 and disposed between the third through hole 655*g* and the first through hole 655*b*, and a vertical guide 655*e* vertically extending from the stopper 655*d* to be inserted into the third through-hole 655*g*. The guide 655*e* and the third through-hole 655*g* provide for means for guiding the movement of the driven body 651.

Hereinafter, an operation of the first switch 61 and 63 and the second switch 65 having the above structure will be described with reference to FIG. 5 and FIG. 7.

When external force is applied to the handle 4 in the state shown in FIG. 5, the first input 45 presses the inclined face 615*b* disposed on the first contact 615, and, at the same time, the second input 46 presses the inclined face 635*b* disposed on the second contact 635.

When the inclined face 615*b* of the first contact and the inclined face 635*b* of the second contact are pressed in the above manner, the first driving body 611 and the second driving body 631 move toward the handle 4. That is, the first driving body 611 moves in a direction away from the first hinge 51, while the second driving body 631 moves away from the second fastener 311*b*.

Figure 7:
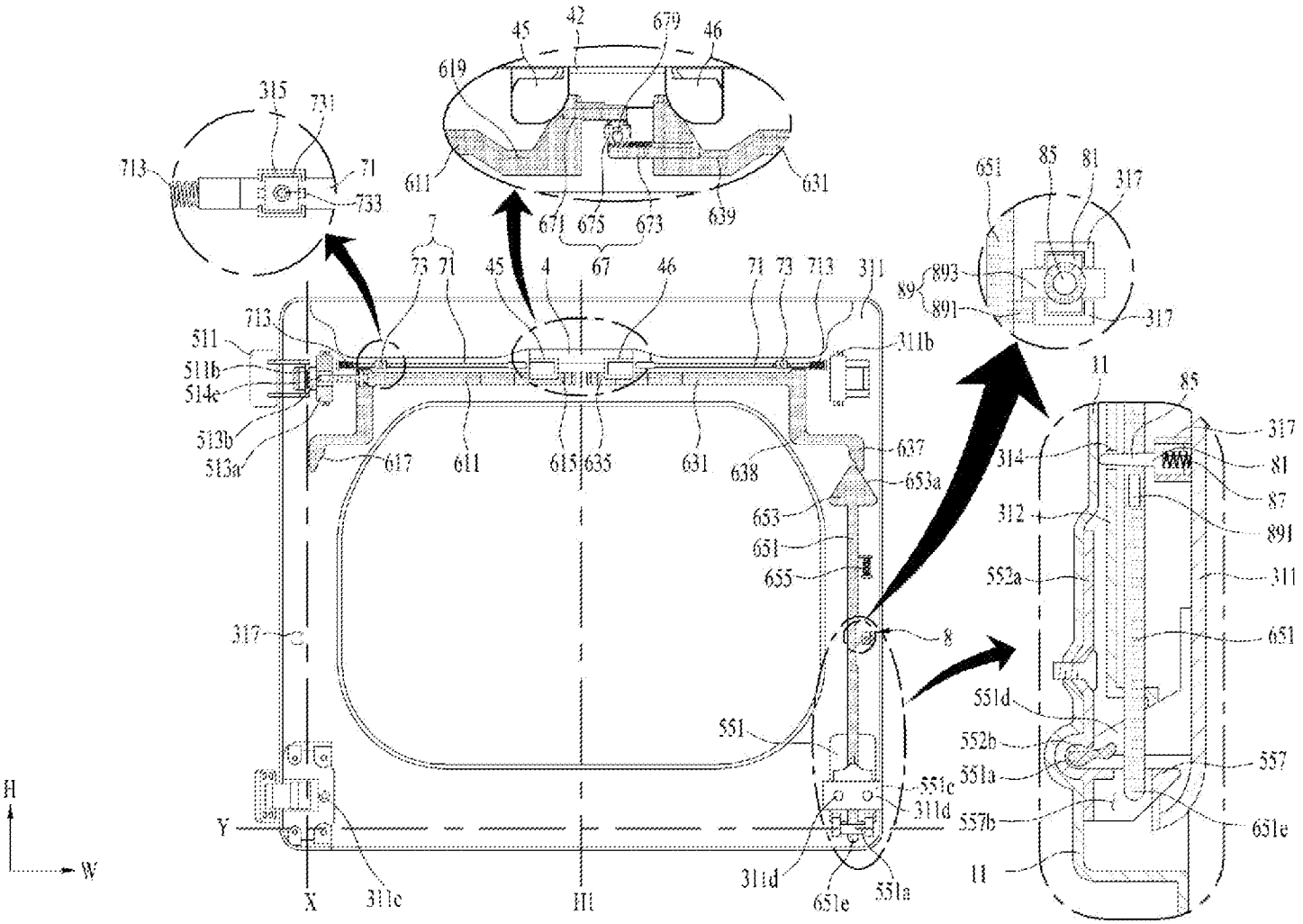

As shown in FIG. 7, when the first driving body 611 moves toward the handle 4, the first bar 514*a* of the first shaft controller will move toward the handle 4. When the first bar 514*a* moves toward the handle 4, the free end 514*e* of the first bar will open the first shaft receiving space 513*b*. Thus, the first shaft 511*b* is ready to be drawn out from the first shaft receiving space 513*b*.

Meanwhile, when the second driving body 631 moves toward the handle 4, the second movable portion 637 may move toward the handle 4. Thus, the driven body 651 in contact with the second movable portion 637 via the first inclined contact face 653*a* will move toward the fourth shaft 551*a*.

When the driven body 651 moves toward the fourth shaft 551*a*, the free end 651*e* of the driven body will move toward the through-hole 557*b* defined in the switch receiving portion 557.

When the driven body free end 651*e* is inserted into the through-hole 557*b*, the fourth shaft receiving space 552*b* is closed by the driven body 651. Thus, the fourth shaft 551*a* will not be drawn out of the fourth shaft receiving space 552*b*. Therefore, the door 3 will be pivotable around the second pivoting axis Y.

When the external force input to the handle 4 disappears, the first switch 61 and 63 and the second switch 65 return to the state of FIG. 5 via the elastic member 514*c* disposed on the first shaft controller and via the elastic member 655 disposed on the second switch.

That is, when the laundry inlet 111 is closed by the door and when the external force input to the handle 4 disappears, the first bar 514*a* of the first shaft controller and the first driving body 611 move away from the handle 4 via the elastic member 514*c*.

When the first bar 514*a* moves away from the handle 4, the first shaft receiving space 513*b* will be closed by the first bar free end 514*e*. Thus, the first shaft 511*b* inserted in the first shaft receiving space 513*b* may be prevented from being drawn out from the first shaft receiving space 513*b*.

When the external force input to the handle 4 disappears, the restoring force provided by the restoring means 655 may allow the driven body 651 to move in a direction away from the fourth shaft 551*a*. Then, the second driving body 631 may move in a direction away from the handle 4 via the first inclined contact face 653*a* and the second movable portion 637.

When the driven body 651 moves away from the fourth shaft 551*a*, the free end 651*e* of the driven body may be drawn out from the through-hole 557*b*. Thus, the fourth shaft 551*a* may be drawn out from the fourth shaft receiving space 552*b*.

In this state, the user pulls the door 3 without pressing the handle 4. Thus, the door 3 will pivot around the first pivoting axis X to open the laundry inlet 111.

The laundry-treating apparatus 100 having the above-described structure has the effect of facilitating the change of the position of the first pivoting axis X from one of the left side and the right side of the door to the other of the left side and right side of the door 3.

The users of the laundry-treating apparatus may be classified into a left-handed person and a right-handed person. Thus, the manufacturer of the laundry-treating apparatus or the installer of the laundry-treating apparatus need to change the position of the first pivoting axis X according to the user's preference. The laundry-treating apparatus 100 according to the present disclosure facilitates changing the position of the first hinge 51 from the left side of the door to the right or from the right side of the door to the left side, moving the second hinge 53 toward the third hinge 55, and moving the third hinge 55 toward the second hinge 53. Thus, this may simplify the process of changing the first pivoting axis X by the producer or installer.

Figure 8:
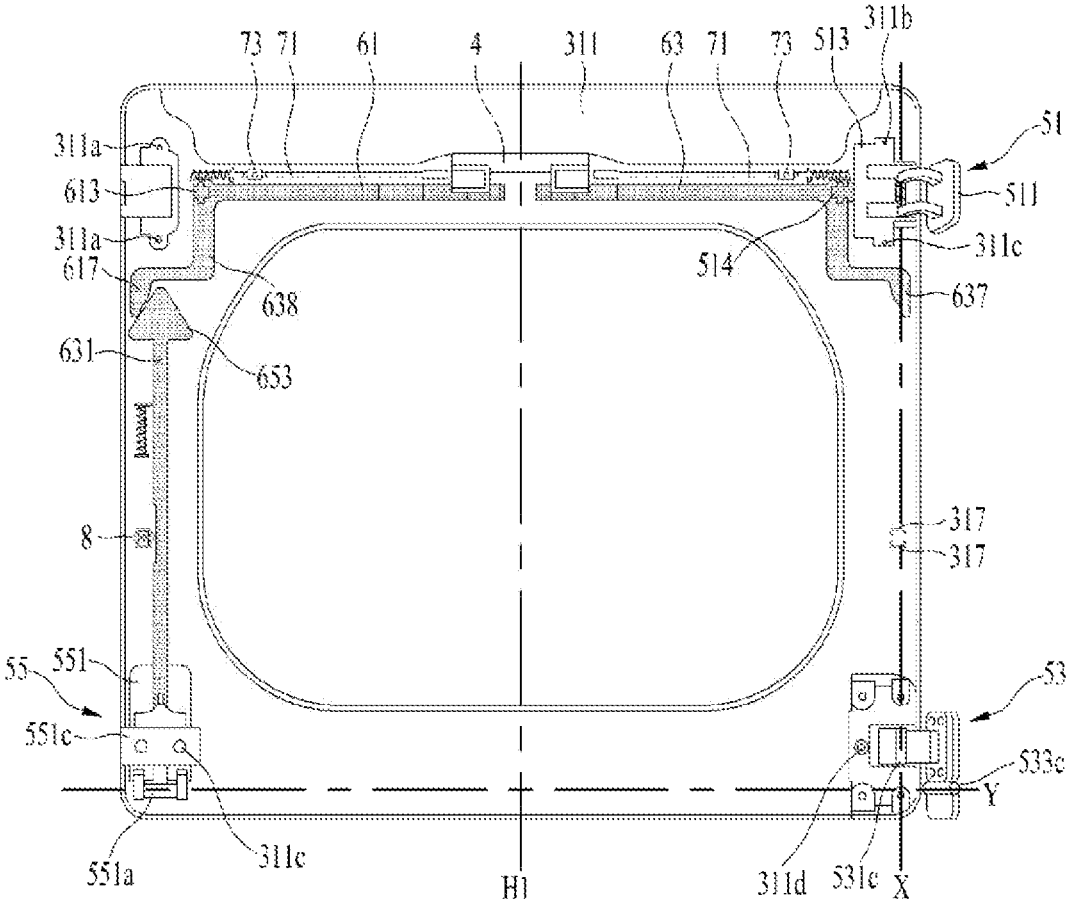
FIG. 8 shows a state in which a position of a first pivoting axis switches from a right side of the door to a left side of the door.

As shown in FIG. 7, the first hinge 51 includes the first shaft controller 514. The first shaft controller 514 may be coupled to each of the first driving body 611 and the second driving body 631. The first fastener 311*a* and the second fastener 311*b* are axially symmetrical with each other around the vertical line H1. Thus, when, as shown in FIG. 8, changing the position of the first hinge 51, the producer or the operator only needs to move the first hinge 511 from the first fastener 311*a* to the second fastener 311*b* while maintaining the first driving body 611 and the second driving body 631 as they are.

Further, the shaft cover fastener 311*c* and the body fastener 311*d* are axially-symmetrical with each other about the vertical line H1. Thus, when changing the position of the second hinge 53 and the third hinge 55, it may suffice that the operator secures the second hinge 53 to the door via the body fastener 311*d*, and secures the third hinge 55 to the door via the shaft cover fastener 311*c*. In this case, the operator must move the second switch 65 so that the first inclined contact face 653*a* contacts the first movable portion 617.

In one example, the laundry-treating apparatus 100 according to the present disclosure must actuate the first driving body 611 and the second driving body 631 separated from each other using a single handle 4. Thus, for the actuation of the handle 4, the user must input a large force into the first handle body 41.

In order to minimize a magnitude of the external force input to the handle 4 for the actuation of the first driving body 611 and the second driving body 631, the laundry-treating apparatus 100 according to the present disclosure may further include a power transmission mechanism 67.

As shown in FIG. 7, the power transmission mechanism 62 may include a first rack 671 fixed to the first contact 615 and projecting toward the second contact 675, a second rack 673 fixed to the second contact 635 and projecting toward the first contact 615, and a connection gear 675 which connects the first rack 671 to the second rack 673.

The connection gear 675 is rotatably secured to the door 3 via a shaft 679 to connect the first rack 671 and the second rack 673 to each other. Therefore, this configuration may allow transmitting the external force inputted to one of the first rack 671 and the second rack 673 to the other rack.

In one example, in the laundry-treating apparatus 100 having only the structure described above, when the door 3 pivots around the first pivoting axis X and when the user presses the first handle body 41 and inputs an external force to the handle, the first shaft 511*b* may be separated from the first shaft receiving structure 513.

Further, in the laundry-treating apparatus 100 having the above-described structure, when the door 3 pivots around the second pivoting axis Y, the first body 41 must be kept at a pressed state to prevent the free end 651*e* of the second switch from being drawn out from the through-hole 557*b*, that is, to prevent the fourth shaft from being drawn out from the fourth shaft receiving space.

In order to solve the above-mentioned disadvantages, the laundry-treating apparatus 100 according to the present disclosure may further include locking means 7 and 8. When the door 3 opens the laundry inlet 111, that is, when the door body is detached from the front panel, the locking means 7 and 8 fix the position of the first switch 61 and 63 and second switch 65.

FIG. 7 shows an example in which the locking means includes both a first lock 7 that locks the position of the first switche 61 and 63 and a second lock 8 that locks the position of the second switch 65.

Figure 9:
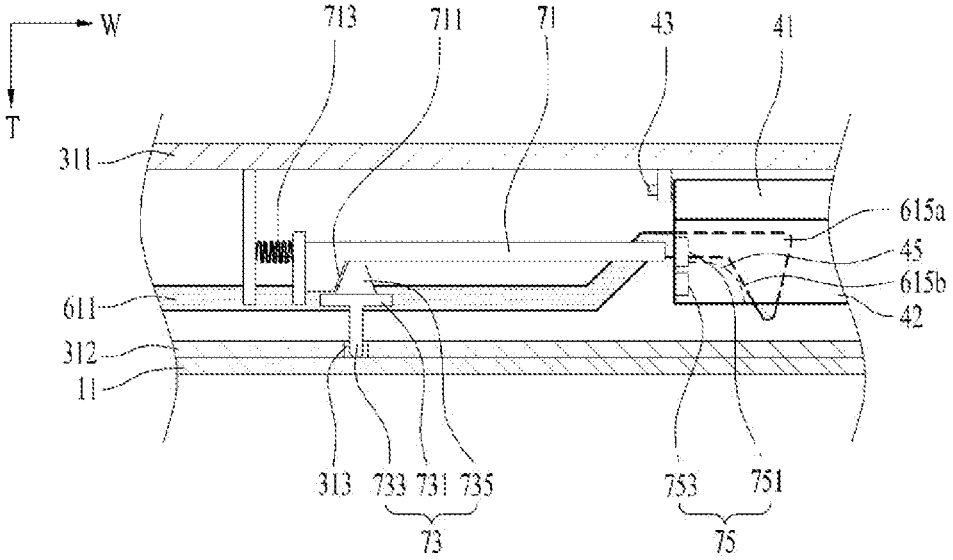
FIG. 9 and FIG. 10 illustrate one example of first and second locks in accordance with the present disclosure.

As shown in FIG. 9, the first lock 7 may include a first lock body 71 detachably mounted on the handle 4, and a first movable lock portion 73 for allowing the first lock body 71 to reciprocate along a width direction W of the door 3 inside the door body 31.

The first lock body 71 may include a bar shaped bar. The first lock body 71 may be pressed by a first lock support 713 toward the second handle body 42. The first lock support 713 may include a spring for urging a free end of the first lock body 71 toward the second handle body 42.

The first lock body 71 has a first inclined lock face 711 which is urged by the first movable lock portion 73. The first inclined lock face 711 may have an upwards slope as it goes away from the handle 4.

When the door 3 closes the laundry inlet 111, the first movable lock portion 73 moves the first lock body 71 in a direction away from the second handle body 42. When the door 3 opens the laundry inlet 111, the first movable lock portion 73 moves the first lock body 71 toward the second handle body 42.

To this end, the first movable lock portion 73 may include a movable body 731 which reciprocates along the thickness direction T of the door 3, and pressing means 733 and 735 for separating the first lock body 71 from the second handle body 42 upon contacting the front panel 11.

In order to guide the movement of the movable body 731, the door includes a first guide 315 (see FIG. 7).

The pressing means may include first pressing means (or first spring) 733 fixed to the movable body 731 and passing through the inner frame 312, and second pressing means (or second spring) 735 fixed to the movable body 731 and contacting the first inclined lock face 711. In this case, the inner frame 312 may further include a first through-hole 313 into which the first pressing means 733 is inserted.

The first movable lock portion 73 may be fixed to the front panel 11, unlike the manner as shown in the drawing. In this case, when the door 3 closes the laundry inlet 11, the first movable lock portion 73 may be configured to be inserted into the first through-hole 313 to press the first inclined lock face 711.

In one example, the first lock body 71 may be coupled to the second handle body 42 via a first lock catch 75. In this case, the first lock catch 75 may include a first stopper 751 and a second stopper 753 disposed on the second handle body 42 and receiving the free end of the first lock body 71.

When the user pivots the door 3 without pressing the first handle body 41, that is, when the door pivots around the first pivoting axis, the first lock body 71 is coupled to the first stopper 751. When the user presses the first handle body 41 and pivots the door 3, that is, when the door pivots about the second pivoting axis, the first lock body 71 is coupled to the second stopper 753.

Figure 10:
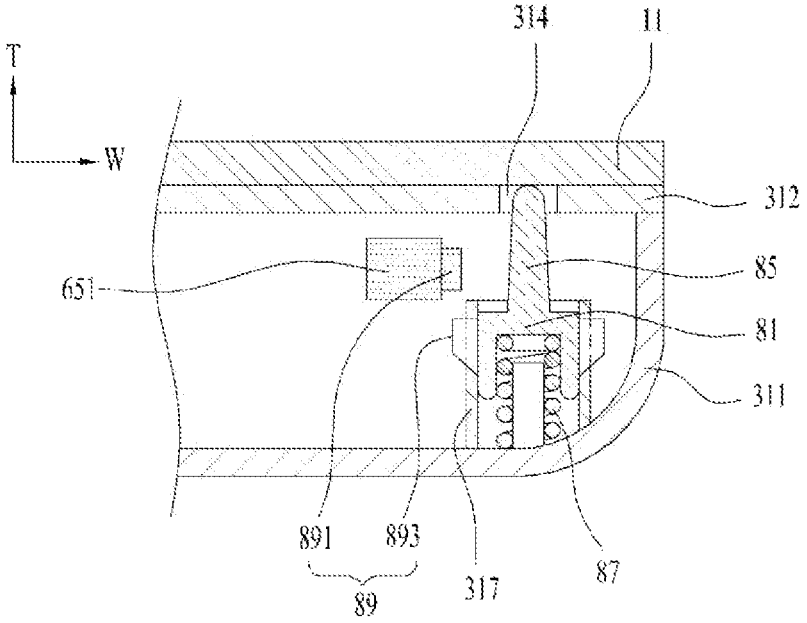
Figure 10:
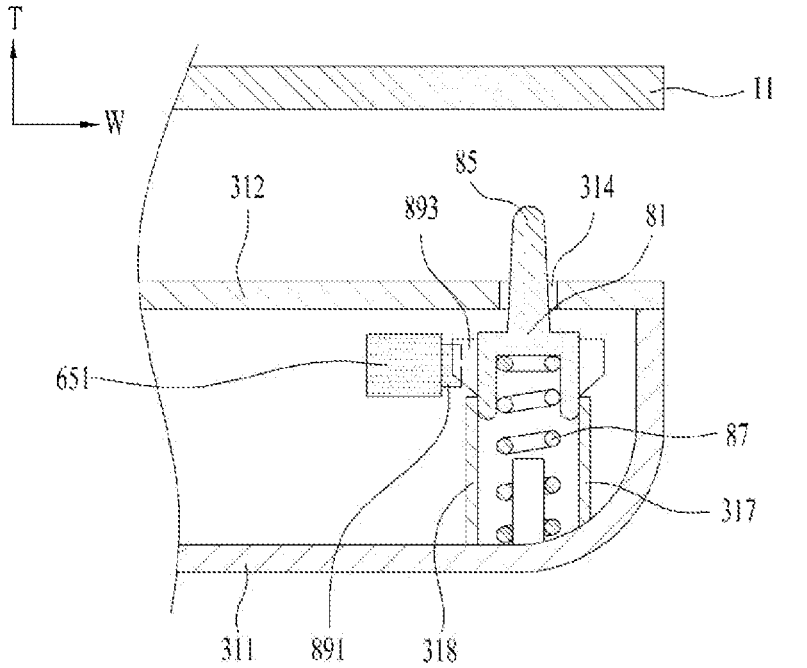

As shown in FIG. 10, the second lock 8 may include a second lock body 81 which reciprocates within the door 3 along the thickness direction T of the door 3, a second lock support 87 that provides a restoring force to the second lock body 81, a second movable lock portion 85 that moves the second lock body 81 in a direction away from the front panel 11 when the door 3 closes the laundry inlet, and a second lock catch 89. When the door 3 closes the laundry inlet 11, the second lock catch 89 separates the second lock body 81 from the second switch 65. When the door 3 opens the laundry inlet 11, the second lock catch 89 connects the second lock body 81 to the second switch 65.

The second lock body 81 reciprocates inside the door 3 under a guidance of a second guide 317 disposed on the door 3. The second lock support 87 may include a spring connecting the second lock body 81 and the door body 31. In this case, the second lock support 87 is preferably configured to press the second lock body 81 toward the inner frame 312 (towards the laundry inlet).

The second movable lock portion 85 may be fixed through the inner frame 312 to the second lock body 81. In this case, the inner frame 312 should have a second through-hole 314 defined therein through which the second movable lock portion 85 passes.

In an alternative, the second movable lock portion 85 may be fixed to the front panel 11. In this case, the second movable lock portion 85 should be configured to be inserted into the second through-hole 314 to press the second lock body 81 when the door 3 closes the laundry inlet 111.

The second lock catch 89 may include a first stopper 891 disposed on the second switch 65, and a second stopper 893 disposed on the second lock body 81 and removably mounted on the first stopper 891.

The second lock catch 89 may be configured in any form as long as it can implement the above function. FIG. 10 shows one example that the first stopper 891 protrudes from an outer peripheral surface of the driven body 651 and a second stopper 893 protrudes from an outer circumferential surface of the second lock body 81.

An actuation process of the door 3 using the locking means 7 and 8 disposed will be described below.

When the door body 31 closes the laundry inlet 111, the first movable lock portion 73 and the second movable lock portion 85 are kept at the pressed state by the front panel 11. Thus, the first lock body 71 maintains a state (FIG. 9) in which the first lock body 71 is separated from the handle 4. The second stopper 893 of the second lock body 81 maintains a state (FIG. 10*a*) in which the stopper 893 is separated from the first stopper 891.

In this state, when the user does not press the first handle body 41 and when the door body 31 is detached from the front panel 11 by the user (when pivoting the door body around the first pivoting axis X), the external force input to the first movable lock portion 73 and the second movable lock portion 85 via the front panel 11 disappears. Thus, the first lock body 71 is coupled to the first stopper 751 to prevent the first handle body 41 from pivoting. The second lock body 81 prevents the second stopper 893 from rising to a lateral face of the first stopper 891 and thus prevents the second switch 65 from moving toward the fourth shaft 551*a* (See FIG. 10*b*).

When the first lock body 71 is inserted into the first stopper 751, the pivoting of the second handle body 42 is prevented even when an external force is applied to the first handle body 41 while the door body 31 pivots around the first pivoting axis X. Thus, the first switch 61 and 63 may not move. Accordingly, in accordance with the present disclosure, even when an external force is applied to the handle 4 while the door body 31 pivots around the first pivoting axis X, the first shaft 511*b* may be prevented from being drawn out from the first shaft receiving space 513*b*.

In one example, when the door body 31 pivots about the first pivoting axis X, the first movable lock portion 73 may be pressed by the user or an object to switch the first body 41 into a pivotable state. This may be problematic. However, according to the present disclosure, the second lock 8 may fix the position of the second switch 65 to prevent the actuation of the second driving portion 63. Thus, the first shaft 511*b* may be prevented from being drawn out from the first shaft receiving space 513*b*.

As shown in FIG. 7, when the user presses the first handle body 41 and detaches the door body 31 from the front panel 11 (when pivoting the door about the second pivoting axis Y), the free end 651*e* of the second switch is inserted into the through-hole 557*b* to prevent the fourth shaft 551*a* from being drawn out of the fourth shaft receiving space 555.

Further, since the first movable lock portion 73 and the second movable lock portion 85 are separated from the front panel 11, the first lock body 71 is coupled to the second stopper 751 to prevent the first handle body 41 from pivoting. The second lock body 81 prevents the second stopper 893 from rising to a side face of the first stopper 891 and thus prevents the free end 651*e* of the second switch from being drawn out of the through-hole 557*b*.

When the first lock body 71 is inserted into the second stopper 751, the first handle body 41 may be maintained at a pivotable state. Accordingly, in accordance with the present disclosure, even the user does not keep the first handle body 41 at the pressed state while the door body 31 pivots around the second pivoting axis Y, the fourth shaft 551*a* may be prevented from being pulled out of the fourth shaft receiving space 555.

In one example, the door 3 may have only the first lock 7. In this case, when the first movable lock portion 73 is pushed while the door body 31 pivots about the second pivoting axis Y, the fourth shaft 551*a* may be disengaged from the fourth shaft receiving space 555. This may be problematic. However, in accordance with the present disclosure, the above problem may be avoided using the second lock 8.

Figure 11:
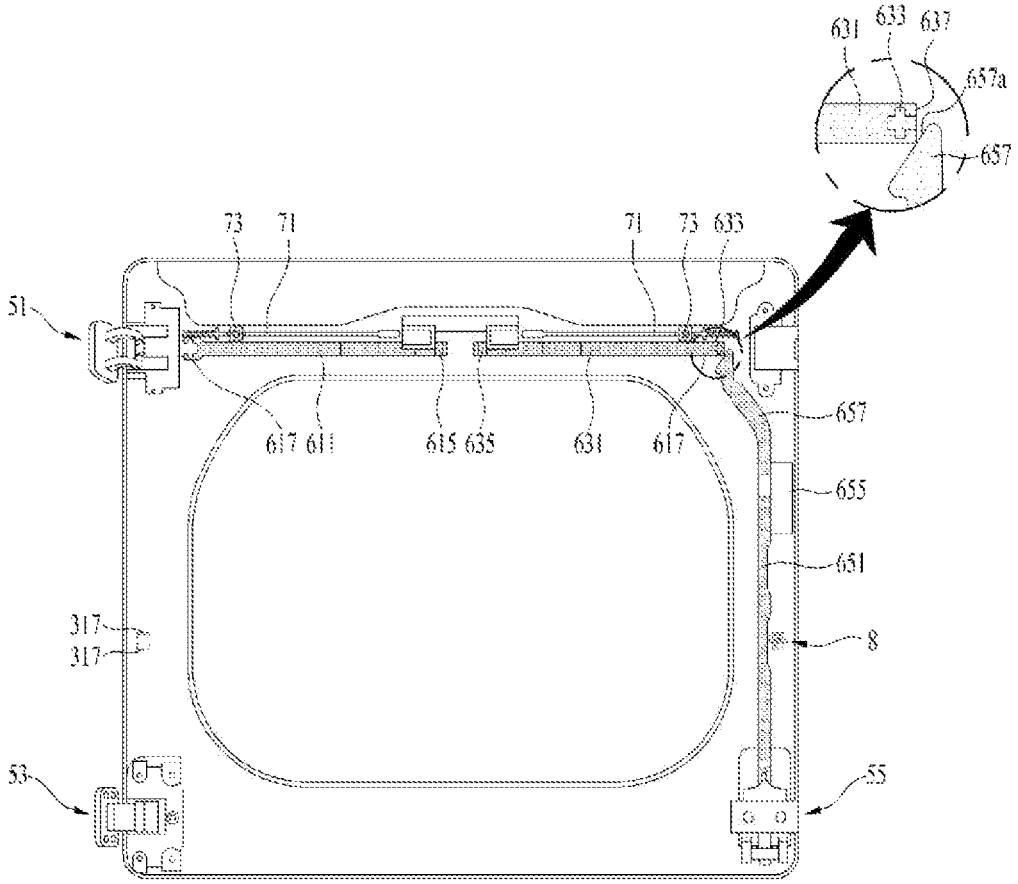
FIG. 11 shows another embodiment of the second switch in accordance with the present disclosure.

In the above embodiments, the shapes of the first switch 61 and 63 and the second switch 65 may be modified to shapes shown in FIG. 11. A embodiment of FIG. 11 may be different from the above embodiments due to a feature that the first connection bar 618 of the first driving portion 61 and the second connection bar 638 of the second driving portion 63 are omitted but the second switch 65 includes a connection bar 657.

In this case, the connection bar 657 would have an inclined face 657*a* as pressed by the first movable portion 617 of the first driving portion or by the second moving portion 637 of the second driving portion.

The inclined face 657*a* should be configured to move the driven body 651 such that the free end 651*e* of the driven body is inserted into the through-hole 557*b* when an external force is input to the handle 4 and thus the first shaft controller 514 opens the first shaft receiving space 513*b*.

The present disclosure may be embodied in various forms without departing from the scope of the invention. Therefore, when modified embodiments include elements recited claims according to the present disclosure, the modified embodiments should be regarded as belonging to the scope of the present disclosure.

What is claimed is:

1. A laundry-treating apparatus comprising:

a cabinet having an inlet;

a door configured to open or close the inlet;

a first hinge including:

a first shaft positioned on one of the cabinet or the door and axially extending along a first pivoting axis for the door; and a first receiving space positioned on another one of the cabinet or the door that does not include the first shaft, wherein the first receiving space is configured to removably receive the first shaft therein;

a second hinge including:

a second shaft coupled to the door, wherein the second shaft axially extends along the first pivoting axis; and a third shaft that pivotably couples the second shaft to the cabinet, wherein the third shaft axially extends along a second pivoting axis for the door that differs from the first pivoting axis;

a third hinge including:

a fourth shaft positioned on one of the cabinet or the door, wherein the fourth shaft axially extends along the second pivoting axis; and a fourth shaft receiving space positioned on another one of the cabinet or the door that does not include the fourth shaft, wherein the fourth shaft receiving space is configured to removably receive the fourth shaft therein;

a handle positioned on the door;

first and second driving linkages positioned to contact the handle, wherein when force is applied to the handle, each of the first and second driving linkages is configured to move toward or away from the handle;

a first shaft latch operatively coupled to the first driving linkage and configured to move to open or close the first shaft receiving space during actuation of the first driving linkage; and a driven linkage, wherein when, upon application of force to the handle, the first driving linkage moves the first shaft latch to open the first shaft receiving space, the second driving linkage moves to cause the driven linkage to move toward the third hinge to close the fourth shaft receiving space.

2. The laundry-treating apparatus of claim 1, further comprising:

a first fastener configured to be positioned on the door to secure a housing defining the first shaft receiving space such that when the first fastener secures the housing to the door, the first shaft receiving space faces a free end of the first driving linkage;

a second fastener configured to be positioned on the door to secure the housing such that when the second fastener secures the housing to the door, the first shaft receiving space faces a free end of the second driving linkage, wherein the second fastener is positioned to be axially symmetric with the first fastener around a vertical line passing through a center of the door;

a cover positioned on the door to pivotably secure the second shaft to the door;

a cover fastener positioned on the door to secure the cover to the door; and a fastener positioned on the door to secure the fourth shaft to the door, wherein the fastener is positioned to be axially symmetric with the cover fastener around the vertical line passing through the center of the door.

3. The laundry-treating apparatus of claim 1, wherein the first hinge further includes:

a housing configured to be secured to the door, the housing defining the first shaft receiving space;

a guide provided on the housing and defining a path to guide a movement of the first shaft latch; and a spring having a first end contacting the housing and a second end contacting the first shaft latch, wherein the spring provides a force to push the first shaft latch to close the first shaft receiving space.

4. The laundry-treating apparatus of claim 3, further comprising:

a first slot defined in the first driving linkage, wherein the first shaft latch is configured to be removably inserted into the first slot;

a second slot defined in the second driving linkage, wherein the first shaft latch is configured to be removably inserted into the second slot;

a first fastener positioned on the door and configured to secure the housing to face a free end of the first driving linkage;

a second fastener positioned on the door and configured to secure the housing to face a free end of the second driving linkage, wherein the second fastener is positioned to be axially symmetric with the first fastener around a vertical line passing through a center of the door;

a cover positioned on the door to pivotably secure the second shaft to the door;

a cover fastener positioned on the door to secure the cover to the door; and a fastener positioned on the door to secure the fourth shaft to the door, wherein the fastener is positioned to be axially symmetric with the cover fastener around the vertical line passing through the center of the door.

5. The laundry-treating apparatus of claim 4, wherein the driven linkage includes:

a driven link positioned between the second driving linkage and the third hinge, wherein when force is applied to the handle to actuate the second driving linkage, the second driving linkages transmits force to cause the driven link to move to close the fourth shaft receiving space; and a spring that supplies an elastic force to move the driven link to open the fourth shaft receiving space.

6. The laundry-treating apparatus of claim 5, further comprising:

a casing detachably secured to the door, wherein the driven link passes through the casing, wherein the spring has a first end connected to the casing and a second end coupled to the driven link.

7. The laundry-treating apparatus of claim 6, further comprising:

first and second through-holes respectively in top and bottom faces of the casing, wherein the driven link passes through the first and second through-holes;

a third through-hole defined in the bottom face of the casing;

a stopper extending from the driven link, wherein the stopper is positioned between the first through-hole and the third through-hole; and a guide extending from the stopper and inserted into the third through-hole, wherein the guide directs a movement of the driven link.

8. The laundry-treating apparatus of claim 4, wherein the handle includes:

a handle block pivotally secured to the door; and first and second extensions provided on the handle block and spaced apart from each other, wherein the first driving linkage includes a first contact surface, wherein when force applied to the handle causes the handle block to pivot, the first extension presses the first contact surface to move the first driving linkage toward the handle block, and wherein the second driving linkage includes a second contact surface, wherein when force applied to the handle causes the handle block to pivot, the second extension presses the second contact surface to move the second driving linkage toward the handle block.

9. The laundry-treating apparatus of claim 8, further comprising:

a first rack provided at the first contact surface and protruding from the first contact surface toward the second contact surface;

a second rack provided at the second contact surface and protruding from the second contact surface toward the first contact surface; and a connection gear to connect the first rack and the second rack, wherein the connection gear is configured to transmit force between the first rack and the second rack.

10. The laundry-treating apparatus of claim 8, wherein the first driving linkage further includes:

a first driving link positioned between the handle and the first hinge, wherein the first driving link includes the first slot and the first contact surface; and a first linkage extension connected to the first driving link, wherein the second linkage further includes:

a second driving link positioned to be axially symmetrical with the first driving link around the vertical line passing through the center of the door, wherein the second driving link includes the second slot and the second contact surface; and a second linkage extension connected to the second driving link and contacting the driven linkage, wherein the first linkage extension and the second linkage extension are axially-symmetric with each other about the vertical line passing through the center of the door.

11. The laundry-treating apparatus of claim 1, further comprising:

a first lock, wherein the first lock includes a first lock link detachably mounted to the handle, and a first spring that provides an elastic force to move the first lock link toward the handle such that when the door opens the inlet, the elastic force from the first spring causes an end of the first lock link to engage the handle to prevent a movement of the first and second driving linkages.

12. The laundry-treating apparatus of claim 1, further comprising:

a second lock, wherein the second lock includes a second lock link, and a second spring that provides an elastic force to move the second lock link toward the driven linkage such that when the door opens the inlet, the elastic force from the second spring causes the second lock to prevent a movement of the driven linkage.

13. The laundry-treating apparatus of claim 1, further comprising:

a first slot provided in the first driving linkage, wherein the first shaft latch is configured to be removably inserted into the first slot; and a second slot provided in the second, wherein the first shaft latch is configured to be removably inserted into the second slot.

14. The laundry-treating apparatus of claim 11, wherein the handle includes a side surface having a recess, and wherein the elastic force from the first spring causes the end of the first lock link to be received in the recess to prevent the movement of the first and second driving linkages.

15. The laundry-treating apparatus of claim 12, wherein:

a surface of the door includes an opening, when the door is positioned away from the cabinet to open the inlet, the elastic force from the second spring causes the second lock link to move toward the surface of the door such that a first portion of the second lock link extends through the opening and a second portion of the second lock link engages the driven linkage, and when the door is positioned adjacent to the cabinet to close the inlet, the cabinet prevents the first portion of the second lock link from extending through the opening such that the second portion of the second lock link does not engage the driven linkage.

16. A laundry-treating apparatus comprising:

a cabinet having an inlet;

a door configured to open or close the inlet;

a first hinge including:

a first shaft positioned on one of the cabinet or the door and axially extending along a first pivoting axis for the door; and a first shaft receiving space positioned on another one of the cabinet or the door that does not include the first shaft, wherein the first shaft receiving space is configured to removably receive the first shaft therein;

a second hinge including:

a second shaft coupled to one of the door or the cabinet, wherein the second shafts axially extends along the first pivoting axis; and a third shaft that is pivotably coupled to the second shaft and is coupled to another one of the door or the cabinet that is not coupled to the second shaft, wherein the third shaft axially extends along a second pivoting axis for the door that differs from the first pivoting axis;

a third hinge including:

a fourth shaft positioned on one of the cabinet or the door, wherein the fourth shaft axially extends along the second pivoting axis; and a fourth shaft receiving space positioned on another one of the cabinet or the door that does not include the fourth shaft, wherein the fourth shaft receiving space is configured to removably receive the fourth shaft therein;

a handle positioned on the door and configured to move when force is applied;

a first driving linkage including a first contact surface facing the handle;

a second driving linkage including a second contact surface facing the handle; and a driven linkage contacting the second driving linkage, wherein when force is applied to the handle, the handle moves toward the first and second contact surfaces and transfers force to move the first driving linkage and the second driving linkage in opposite directions, the first driving linkage moves to open the first shaft receiving space, and the second driving linkage moves to cause the driven linkage to open or close the fourth shaft receiving space.

17. The laundry-treating apparatus of claim 16, further comprising a first shaft latch coupled to the first driving linkage and configured to move to open or close the first shaft receiving space based on movement of the first driving linkage, wherein the first contact surface is provided at a first end of the first driving linkage, and the first driving linkage further includes a second end that is opposite to the first end and includes a slot configured to receive the first shaft latch.

18. The laundry-treating apparatus of claim 16, wherein the second contact surface is provided at one end of the second driving linkage and extends in a first direction, the second driving linkage further includes a second end that is opposite to the first end and includes a contact protrusion that extends in a second direction the differs from the first direction, and wherein the driven linkage includes a third contact surface that is angled to engage the contact protrusion such that movement of the second driving linkage along the first direction causes the driven linkage to move along the second direction.

19. The laundry-treating apparatus of claim 16, further comprising:

a first rack provided at the first contact surface and protruding from the first contact surface toward the second contact surface;

a second rack provided at the second contact surface and protruding from the second contact surface toward the first contact surface; and a connection gear to connect the first rack and the second rack, wherein the connection gear transmit an external force between the first rack and the second rack.

20. The laundry-treating apparatus of claim 16, wherein the handle includes at least one extension, and when force is applied to the handle, the at least one extension contacts the first and second contact surfaces to move the first driving linkage and the second driving linkage in opposite directions.

* * * * *